United States Patent [19]

Takeuchi

[11] Patent Number: 4,908,766

[45] Date of Patent: Mar. 13, 1990

[54] TRIM TAB ACTUATOR FOR MARINE PROPULSION DEVICE

[75] Inventor: Toshio Takeuchi, Hamamatsu, Japan

[73] Assignee: Sanshin Kogyo Kabushiki Kaisha, Hamamatsu, Japan

[21] Appl. No.: 78,109

[22] Filed: Jul. 27, 1987

[30] Foreign Application Priority Data

Jul. 28, 1986 [JP] Japan ..... 61-175672

[51] Int. Cl.[4] ..... B63H 25/00

[52] U.S. Cl. ..... 364/448; 114/152; 114/285; 440/1; 440/51

[58] Field of Search ..... 440/900, 66, 61, 51, 440/63, 1; 364/448; 318/588; 114/150, 152, 162, 285, 144 R

[56] References Cited

U.S. PATENT DOCUMENTS 4,749,926 6/1988 Ontolchik ..... 318/588
4,762,079 9/1988 Takeuchi et al. ..... 114/152
4,787,867 11/1988 Takeuchi et al. ..... 440/1

FOREIGN PATENT DOCUMENTS 56-160297 12/1981 Japan .

*Primary Examiner*—Thomas H. Tarcza
*Assistant Examiner*—David Cain
*Attorney, Agent, or Firm*—Ernest A. Beutler

[57] ABSTRACT

An improved trim tab actuator for a watercraft for permitting the operator to automatically select any of a plurality of steering effects by automatic control of the trim tab. The trim tab is positioned in response to sense steering and watercraft conditions and the operator may also select any of a plurality of modes mapped in response to these conditions.

16 Claims, 2 Drawing Sheets

TRIM TAB ACTUATOR FOR MARINE PROPULSION DEVICE

BACKGROUND OF THE INVENTION

This invention relates to a trim tab actuator for a marine propulsion device and more particularly to an improved operating arrangement for a trim tab that permits the operator to select any of a wide variety of trim tab functions for assisting in steering.

The use of trim tabs for marine propulsion devices so as to effect the steering of the watercraft are well known. For example, it has been proposed to mount a trim tab on a marine outboard drive and to pivot the trim tab in an opposite direction from the steering direction of the outboard drive so as to create a hydrodynamic force acting upon the outboard drive so as to assist in steering. Such devices normally operate by means including a form of lost motion connection in the steering mechanism. Although these devices are effective in assisting steering, these devices operate on a fixed ratio and hence do not always offer the appropriate degree of control. Furthermore, these devices, because of their fixed nature, only accomplish steering assist and hence do not enjoy the full benefits of the trim tab.

Other types of devices have been incorporated wherein the trim tab may be manually controlled by the operator in such a way that the operator can set the trim tab by a manual selection so as to achieve the desired trim tab function. However, these devices require an operator's continuous attention and hence are not completely satisfactory.

It has also been recently proposed to provide automatic actuators for operating the trim tab in response to sensed conditions of the watercraft and the steering input. For example, in the co-pending application entitled TRIM TAB ACTUATOR FOR MARINE PROPULSION DEVICE, Ser. No. 033,403, filed Apr. 1, 1987, in the names of Toshio Takeuchi and Shinya Atsumi, and assigned to the assignee of this application, there is disclosed an arrangement wherein a computer automatically controls the position of a trim tab so as to maintain a given course setting for the associated watercraft. Furthermore, in co-pending application entitled TRIM TAB ACTUATOR FOR MARINE PROPULSION DEVICE, Ser. No. 033,401, filed Apr. 1, 1987, in the name of Shinya Atsumi, and assigned to the assignee of this application, there is disclosed an arrangement wherein the trim tab can be actuated in such a way so as to provide steering sharpness as opposed to steering assist or directional control to avoid straying from the course set. These co-pending applications disclose other possible utilities for the trim tab. Furthermore, co-pending application entitled TRIM TAB ACTUATOR FOR MARINE PROPULSION DEVICE, Ser. No. 052,712, filed May 20, 1987, in the names of Toshio Takeuchi and Shinya Atsumi, and assigned to the assignee of this application, there is disclosed an arrangement wherein an operator may select one of a plurality of premapped conditions so as to permit the trim tab to be adjusted to achieve the desired steering result. Obviously, each of these three last mentioned co-pending applications indicate that the trim tab may be operated in a wide variety of functions so as to achieve a wide variety of purposes.

It is a purpose of this invention to provide an improved trim tab actuator which permits the operator to select not only the desired type of steering effect that will be accomplished by the trim tab, but also so as to select which of a wide variety of premapped conditions will be operative to control the trim tab position.

It is a further object of this invention to provide a trim tab actuator for a marine propulsion device in which the operator is given a wide variety of controls over both the effect and operation of the trim tab.

SUMMARY OF THE INVENTION

This invention is adapted to be embodied in a watercraft that includes steering means for effecting steering of the watercraft. A steering control is operable by an operator for controlling the operation of the steering means. A trim tab is movably supported by the watercraft from a neutral condition to any of a plurality of positions for creating a steering effect. Means are incorporated for actuating the trim tab between its positions. Means also are provided for sensing a steering input to the steering control and further sensing means are provided for sensing another of the watercraft conditions. A computer means is included that contains a plurality of premapped conditions for the position of the trim tab in response to sensed steering input to the steering control and the watercraft other conditions for achieving different steering effects by the position of the trim tab. Operator control means are incorporated for permitting an operator to select the desired steering effect generated by the trim tab and means are provided for operating the means for activating the trim tab in response to an output signal from the computer.

DETAILED DESCRIPTION OF THE PREFERRED EMBODIMENT

Figure 1:
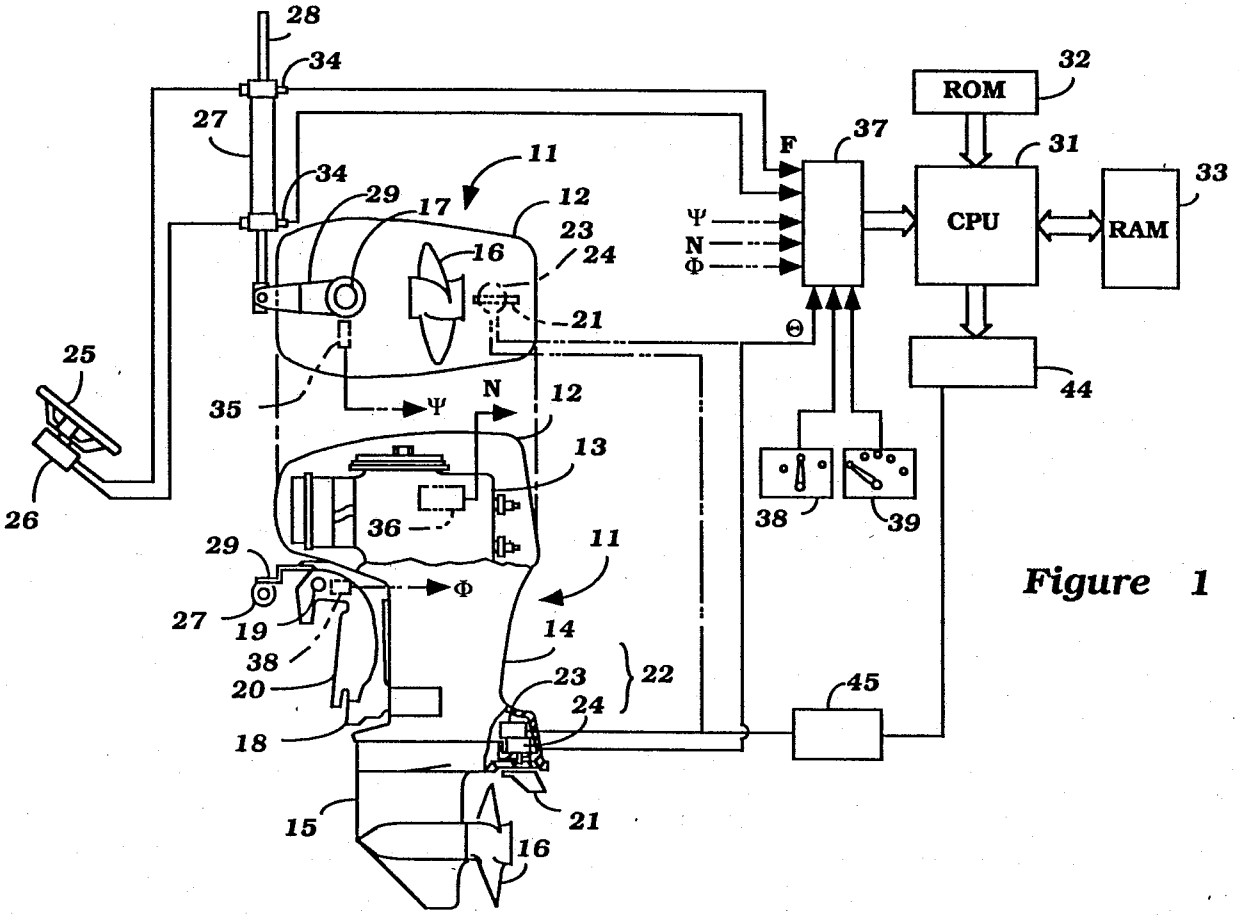
FIG. 1 is a side elevational view, with portions broken away and other portions shown schematically, and partial top plan view of a marine propulsion device embodying a trim tab actuator constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that it may be employed with any form of outboard drive including the outboard drive of an inboard-outboard drive.

The outboard motor 11 includes a power head assembly, indicated generally by the reference numeral 12, and including an internal combustion engine 13, which may be of any known type. The engine 13 drives a drive shaft (not shown) that is journaled within a drive shaft housing 14 that depends from the power head 12. The drive shaft terminates within a lower unit 15 that is positioned at the lower end of the drive shaft housing 14 and drives a propulsion device in the form of a propeller 16 through a suitable forward, neutral, reverse transmission (not shown) which may be of any known type.

In accordance with standard outboard motor practice, the drive shaft housing 14 has affixed to it a steering shaft 17 that is journaled for steering movement about a generally vertically extending axis within a swivel bracket 18. The swivel bracket 18 is, in turn, pivotally connected by means of a pivot pin 19 to a clamping bracket 20. The pivotal connection afforded by the pivot pin 19 permits the outboard motor 11 to be tilted up or swung through a plurality of trim adjusted positions, as is well known in this art. The clamping bracket 20 affords an arrangement for detachably connecting the outboard motor 11 to the transom (not shown) of an associated watercraft. The construction of the outboard motor 11 as thus far described and its connection to the watercraft may be considered to be conventional. For that reason, further details of this construction are not believed to be necessary to understand and practice the invention.

In accordance with the invention, a trim tab, indicated generally by the reference numeral 21, is pivotally supported about an axis that extends parallel to the steering axis by means of the drive shaft housing 14 and in proximity to the lower unit 15 and propeller 16. The trim tab 21 is disposed so that it will be submerged in the water and will generate a hydrodynamic force for creating steering forces upon the outboard motor 11 and upon the associated watercraft.

In accordance with the invention, an actuator device, indicated generally by the reference numeral 22 and including a reversible electric motor 23 and gear reduction unit 24, is coupled to the trim tab 21 for rotating it. The reversible electric motor 23 is controlled by means of a control system, to be described, so as to create the desired hydrodynamic forces upon the outboard motor 11 and the associated watercraft.

The steering mechanism for the outboard motor 11 includes, in addition to the steering shaft 17 and swivel bracket 18, a remotely positioned steering wheel 25. The steering wheel 25 operates a manually operated fluid pump 26 that supplies fluid through a pair of control lines to a hydraulic motor 27 that is mounted in a fixed position relative to the outboard motor 11 adjacent the transom of the associated watercraft. The fluid motor 27 has an internal piston (not shown) which divides the fluid motor 27 into a pair of chambers and which piston is connected to a piston rod 28. The piston rod 28, in turn, has a pivotal connection to one end of a steering arm 29. The steering arm 29 is affixed to the steering shaft 17 and is effective to cause pivotal movement of the outboard motor about the swivel bracket 18.

The trim tab 21 is activated, in a manner to be described, so as to provide the desired steering effect dependent upon the operator's selection. The possible steering effects that may be chosen in the illustrated embodiment are (1) non-course deviation, (2) steering sharpness or response, or (3) steering assist. Other possible effects may be selected by those skilled in the art. The operator may select further control tuning in response to a variety of factors including the condition of the steering input, the actual steered angle of the outboard motor 11 and a variety of variable factors associated with the operation of the outboard motor 11 and the watercraft. Among these additional factors are speed of travel and trim angle. These conditions are, in accordance with the invention, sensed by any of a plurality of sensors, and this information is fed to a central processing unit (CPU) indicated schematically at 31 which CPU also includes a ROM 32 and a RAM 33 and processes these signals and compares with preset values and then control the actuating device 22 so as to set the trim tab 21 in the appropriate position to obtain desired steering effect for the watercraft conditions and those selected by the operator.

Realizing the invention, it is believed to be within the scope of those skilled in the art to determine which of these factors will be employed to achieve the control of the trim tab 21 and how, in fact, they are sensed. It should be understood that with certain watercraft, certain of these factors may be insignificant and others more important.

In the illustrated embodiment, the steering input force F is measured by means of a pair of pressure sensors 34 that are positioned in the chambers at the opposite ends of the fluid motor 27. These devices are pressure devices which indicate a pressure which is equivalent to force input by the operator. It is to be understood, however, that force can be measured in any other manner such as by means of a strain gauge. Also, in cable operated steering mechanisms, the steering force can be measured by a strain gauge to sense the tension in the cable or any other known manner for so measuring forces.

The angle of steered condition of the input to the steering mechanism is measured by a sensor 35 which outputs an angular steering position signal indicated at $\psi$.

Other conditions, such as watercraft speed, are sensed by an engine speed sensor, indicated schematically at 36, which may comprise the pulser coil of the ignition system of the engine 13. This engine speed sensor outputs an engine speed signal N which, with the other sensed condition signals, is delivered to an input interface 37 which converts the signal into an appropriate signal for processing by the CPU 31. Alternatively to sensing engine speed, the watercraft speed may be sensed in any of a variety of fashions, such as by utilizing an actual water speed sensor (ideally a velocity sensor in proximity to the propeller 16) or in any known manner.

In accordance with the illustrated embodiment, the trim angle of the watercraft is also sensed by means of a trim condition sensor 40 that is carried by the swivel bracket 18 and which outputs a trim angle signal $\phi$ to the interface 37 for conversion into an appropriate signal for transmission to the CPU 31. In the illustrated embodiment, trim angle, steering angle, and watercraft velocity are the only three watercraft conditions which are sensed and processed by the CPU 31. As aforenoted, however, a wide variety of other watercraft conditions may be sensed and processed by the CPU 31.

The gear reduction unit 24 also includes an angle position sensor for sensing the angular position of the trim tab 21. This sensor outputs a signal $\theta$ to the interface 37 for conversion into an appropriate signal for processing by the CPU 31.

In addition to the sensing units that provide signals for sensing the various watercraft conditions and the conditions of the steering of the outboard drive 11, there is provided an operator mode selector switch 38 which permits the operator to select the type of effect which will be generated by the trim tab 21. As previously noted, a wide variety of effects may be selected. For example, if the operator desires to have the trim tab 21 positioned by the actuator 22 so as to avoid course deviation, he can select a non-course deviation mode. If, on the other hand, the operator desires to effect a steering sharpness or responsiveness mode, he may select this. Alternatively, the operator may elect to select a maximum steering assist mode. As has been previously noted, the types of steering effects which may be achieved through the use of the trim tab 21 are widely varied and those skilled in the art will readily be able to select which of these effects can be employed.

In addition to selecting the mode for determining the steering effect, there is also provided a further operator control 39 which permits the operator to select one of a plurality of premapped trim tab positions for the sensed conditions to further optimize the selected steering effect or alternatively any of a plurality of preset functions. These premapped conditions or functions may be maximum steering assist, moderate steering assist, low steering assist if steering assist mode has been selected, or any of a wide variety of trim tab conditions that will effect the steering and performance of the outboard drive 11. Also, the premapped conditions or functions may be chosen so as to suit the type of sea conditions such as rough sea, mild sea, etc. A wide variety of maps will present themselves to those skilled in the art and these selected map signals are then transmitted to the CPU 31 via the interface 37 so that the operator can make his selection.

The CPU 31 and its RAM 33 and ROM 32 are preprogrammed so as to compare the steering input forces F, or the steered angle $\psi$ and other desired parameters such as sensed speed N and trim angle condition $\phi$ and to generate an output signal generated by the selected steering effect and one of the series of maps and indicative of the desired trim tab position for these desired effects and sensed conditions and the selected map chosen by the operator's selection by selectors 38 and 39. The CPU 31 also receives the signal indicating the trim tab position $\theta$ and makes an internal comparison to determine if the trim tab angle that is existent is the desired angle or not. This processing may be best understood by reference to FIG. 2, which is a block diagram showing the logic of the CPU 31.

Figure 2:
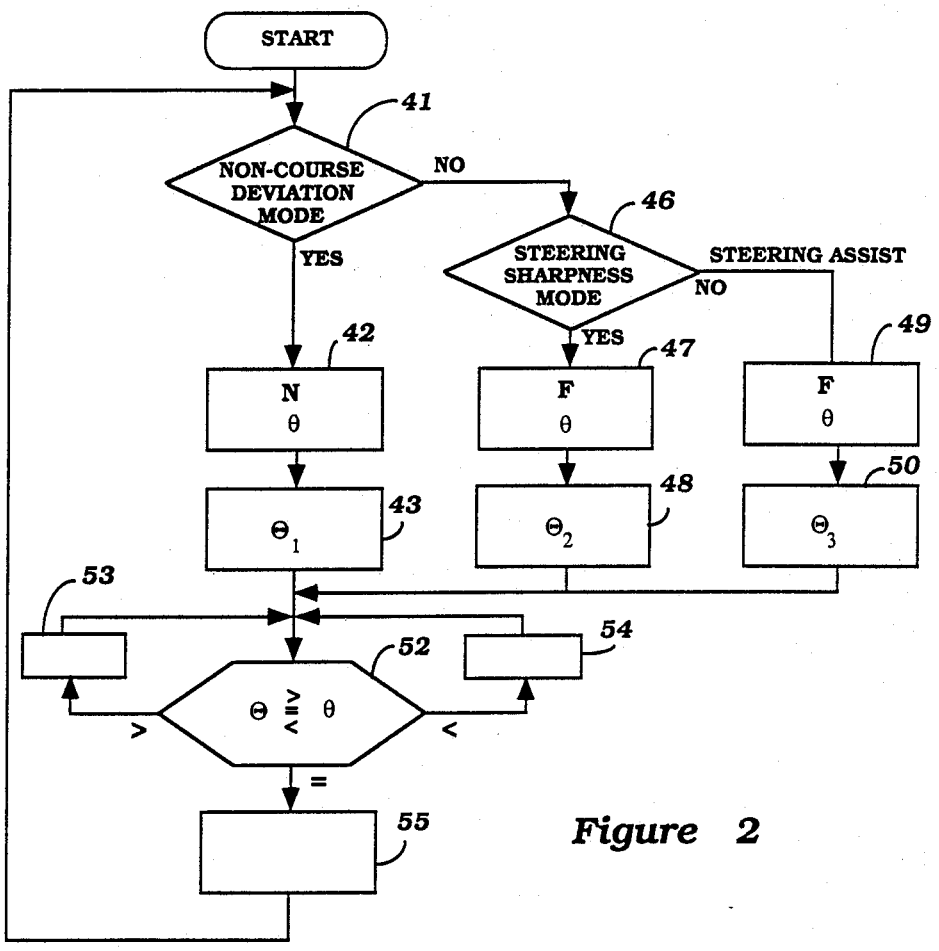
FIG. 2 is a block diagram showing the logic of the CPU and the selective operator control in setting the trim tab device in accordance with an embodiment of the invention.

In FIG. 2, at the initialization or starting step, which is initiated when the main switch (not shown) is switched on, the CPU 31 performs an initialization step and then reads the input signals of steering input force F, or the steering angle $\psi$ and trim tab angle $\phi$ and any other desired condition such as engine speed N, trim angle $\theta$ sequentially through the interface 37 at the step 41. These signals are then stored temporarily in the RAM 27.

After the initialization or starting step, the CPU 31 determines which of the desired steering effects has been selected by the operator's control of the selector 38. The computer moves to a first step 41 to determine if the non-course deviation mode has been selected. If the non-course deviation mode has been selected, the CPU 31 then moves to the step 42 so as to memorize the instantaneous speed of the watercraft N and the actual angular position $\theta$ of the trim tab 21. Then at the step 43 the optimum trim tab angle is determined by the program of the CPU 31 and the specific map or calculated function selected by the operator's control of the selector 39. There is then output a signal $\Theta_1$ that is transmitted to an output interface 44 so as to operate a driver 45 so as to actuate the trim tab actuator 22 in a manner which will be described so as to achieve the optimum trim tab angle for the selected mode and map.

If it is determined at the step 41 that the operator has not selected the non-course deviation mode, the CPU 31 moves to the step 46 to determine if the steering sharpness or responsiveness mode has been selected. If it has, the computer then moves to the step 47 so as to memorize the steering input force F as sensed by the sensors 34 and the actual trim tab angle $\theta$. Then at the step 48 the selected mode and also the map selected by the operator's positioning of the selector 39 is processed by the CPU 31 to output an optimum trim tab angle position $\Theta_2$ that goes to the output interface 44 and driver 45 so as to operate the actuator 22, in a manner to be discussed.

In the event that it is determined at the step 46 that the steering sharpness mode has not been selected, the CPU 31 then determines that the steering assist mode must have been selected. Of course, if more than three modes are provided, there will be a further determination mode like the modes 41 and 46. In the illustrated embodiment that incorporates only three modes, however, if the steering sharpness mode has not been determined as being selected at the step 46, the device immediately moves to the step 49 wherein the steering input force F and trim tab angle $\theta$ are memorized. Then at the step 51, the CPU 31 determines the optimum trim tab angle $\Theta_3$ for the steering assist mode and appropriate map selected by the selector 39 and outputs this signal.

After the output signal appropriate to the selected mode $\Theta_1$, $\Theta_2$ or $\Theta_3$ is generated, the CPU compares that signal with the actual trim tab angle position $\theta$ at the step 52. If clockwise adjustment is necessary, the system moves to the block 53 so as to activate the motor 23 in the appropriate direction through an output interface 44 (FIG. 1) and driver 45 so as to achieve rotation in this direction. On the other hand, if counterclockwise rotation is determined, the system moves to the block 54 and achieves this rotation. The rotation continues cyclically until the comparison indicates that the actual trim tab angle $\theta$ is equal to the desired trim tab angle $\Theta_1$, $\Theta_2$ or $\Theta_3$ and then the program is stopped at the step 55.

In the steering sharpness mode and steering assist mode as described, the input force F has been measured. It is to be understood that the CPU 31 may be programmed so as to set the desired steering angle of the trim tab 21 in response to the actual steered position $\psi$ as sensed by the sensor 35. Alternatively, other parameters, as have been previously described, can be employed for the desired controls.

It should be readily apparent from the foregoing description that a very versatile trim tab actuator has been disclosed in which the operator may select any of a wide variety of steering effects to be generated and also so as to select any of a plurality of preset mapped conditions so as to achieve the optimum effect for the sensed and desired conditions.

Although the foregoing is a description of a preferred embodiment of the invention and certain variations of that embodiment have been disclosed, other variations and modifications may be made without departing from the spirit and scope of the invention, as defined by the appended claims.

I claim:

1. In a watercraft, steering means for effecting steering of said watercraft, a steering control operable by an operator for controlling the operation of said steering means, a trim tab movably supported by said watercraft from a neutral condition to any of a plurality of positions for creating a steering effect, means for actuating said trim tab between said positions, means for sensing a steering input to said steering control, means for sensing another watercraft condition, computer means for containing a plurality of premapped conditions for the positioning of said trim tab in response to sense steering input to said steering control and to said watercraft other condition for achieving different steering effects by the position of said trim tab, operator control means for permitting an operator to select the desired steering effect generated by said trim tab, and means for operating said means for activating said trim tab in response to an output signal from said computer means.

2. In a watercraft as set forth in claim 1 wherein the computer means further contains a plurality of maps and operator selective means for selecting which of the maps will control to achieve the desired conditions for the desired steering effect.

3. In a watercraft as set forth in claim 1 wherein one of the desired steering effects comprises steering sharpness or responsiveness.

4. In a watercraft as set forth in claim 3 wherein another of the steering effects comprises steering assist.

5. In a watercraft as set forth in claim 3 wherein another of the steering effects comprises steering deviation control for maintaining a predetermined course.

6. In a watercraft as set forth in claim 4 wherein one of the the desired steering effects comprises steering sharpness or responsiveness.

7. In a watercraft as set forth in claim 1 wherein one of the desired steering effects comprises a steering assist.

8. In a watercraft as set forth in claim 1 wherein one of the steering effects comprises non-course deviation control.

9. In a watercraft as set forth in claim 1 wherein the steering means comprises an outboard drive supported for pivotal movement about a vertically extending steering axis on the transom of the watercraft and including propulsion means for propelling the watercraft, the trim tab being pivotally supported on said outboard drive.

10. In a watercraft as set forth in claim 9 wherein the computer means further contains a plurality of maps and operator selective means for selecting which of the maps will control to achieve the desired conditions for the desired steering effect.

11. In a watercraft as set forth in claim 9 wherein one of the desired steering effects comprises steering sharpness or responsiveness.

12. In a watercraft as set forth in claim 11 wherein another of the steering effects comprises steering assist.

13. In a watercraft as set forth in claim 11 wherein another of the steering effects comprises steering deviation control for maintaining a predetermined course.

14. In a watercraft as set forth in claim 13 wherein another of the steering effects comprises steering assist.

15. In a watercraft as set forth in claim 9 wherein one of the desired steering effects comprises a steering assist.

16. In a watercraft as set forth in claim 9 wherein one of the steering effects comprises non-course deviation control.

* * * * *